United States Patent [19]

Hall, Sr.

[11] Patent Number: 4,721,044

[45] Date of Patent: Jan. 26, 1988

[54] RAIL CAR SKID INSERTION DEVICE

[76] Inventor: Meryl M. Hall, Sr., HC 69 Box 76, Herndon, W. Va. 24726

[21] Appl. No.: 908,034

[22] Filed: Sep. 16, 1986

[51] Int. Cl.[4] ..... B61H 7/06

[52] U.S. Cl. ..... 104/259; 104/260

[58] Field of Search ..... 104/249, 257, 259, 260; 188/62, 63

[56] References Cited

U.S. PATENT DOCUMENTS

| | | | |
|---|---|---|---|
| 1,547,936 | 7/1925 | McGahey | 104/260 X |
| 1,580,836 | 4/1926 | McGahey | 104/259 X |
| 1,584,031 | 5/1926 | Hannauer et al. | 104/259 X |
| 3,128,723 | 4/1964 | Smith | 104/260 |
| 3,450,061 | 6/1969 | Blomecke et al. | 104/259 |

FOREIGN PATENT DOCUMENTS

| | | | |
|---|---|---|---|
| 114035 | 3/1926 | Switzerland | 104/259 |

*Primary Examiner*—Robert B. Reeves
*Assistant Examiner*—Thomas W. Kearns
*Attorney, Agent, or Firm*—Clifford A. Poff; Thomas H. Murray

[57] ABSTRACT

A rail car skid insertion device for remotely inserting a skid onto a rail head of a rail spur to impede movement of a rail car is disclosed. The device includes a skid removably attached to a carrier arm mounted on a slide bar. The skid is attached to the carrier arm at a safe distance from a rail head. The slide bar may then be translated such that the skid is positioned on the rail head. The removable attachment allows a wheel of a moving rail car to drag the skid off of the carrier arm. The skid prevents the rail car wheel from rotating, thereby reducing the speed of the rail car. After the skid has been removed from the carrier arm, the slide bar may be retracted, and another skid attached, thereby allowing remote insertion of another skid onto the rail head after the wheel of the rail car moves from the skid, the skid rails on the rail head and falls automatically on the road bed at one side of the rail. For this purpose, the skid embodies a continuation that brings about an unbalanced net force due to gravity.

18 Claims, 6 Drawing Figures

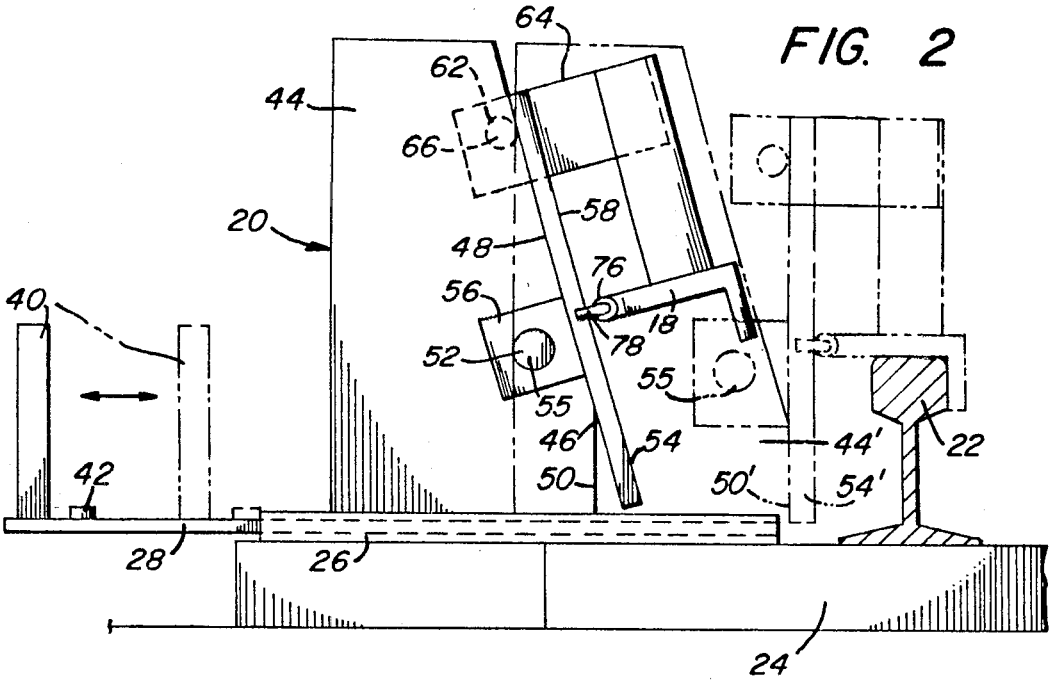
FIG. 2
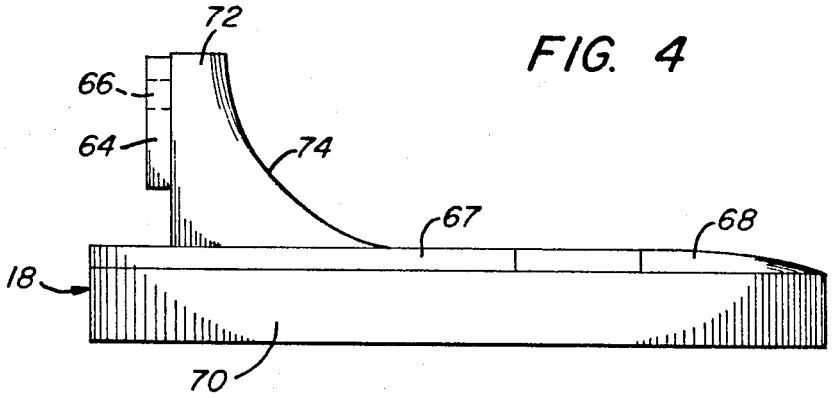
FIG. 4
FIG. 4A
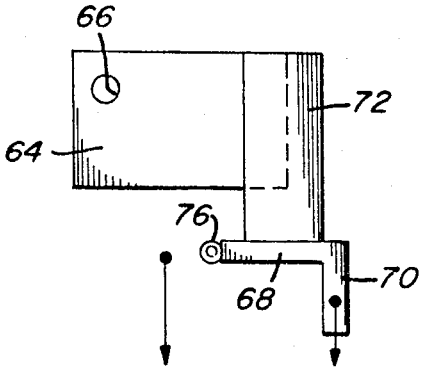

RAIL CAR SKID INSERTION DEVICE

BACKGROUND OF THE INVENTION

1. Field of the Invention

This invention relates generally to remote insertion devices, and more specifically, to a device for remotely inserting a skid on a rail head in order to prevent movement of a mine rail car.

2. Description of the Prior Art

In any mining process, the mineral must first be mined, and then transported to the surface after which the mineral may be shipped to customers. When mining a bulk material such as coal, the mined mineral is typically transported to the surface whereupon the mineral is further processed, and then shipped to the customer.

Methods exist to load the bulk mineral onto a series of mine rail cars while in the mine, and also to control movement of the mine rail cars once they have been transported to the surface. Additionally, methods exist to control the movement of rail cars containing the processed mineral while the rail cars await shipment to the customer.

Loading of the mine rail cars is a continuous process. The loading area is typically along a portion of a rail spur upon which mine rail cars have been positioned. The rail spur follows the terrain of the mine, and contains grades as well as level stretches. As the location of the mining area changes, so does the loading area. The loading area must frequently be located on a grade, and at times the grade is severe. Conveyors move the mined mineral to the underground loading area and dumps the mineral into a loading hopper positioned above the rail spur of the loading area from which the mineral is then discharged into a mine rail car.

The mine rail cars must be positioned beneath the loading hoppers, and must be repositioned as each rail car is filled. The cars are initially positioned with a first car underneath the loading hopper. Car spotters positioned between the rail spur are caused to contact with mine rail car frames by hydraulical actuators and are used to position the mine rail cars beneath the loading hopper by pushing the cars on the rail spur which may be along a level area or on a down grade, depending upon the location of the loading area. However, the typical car spotter has provisions only for "pushing" contact with the mine car, and is not rigidly attached to the mine car. Therefore, car spotters cannot control the forward movement of mine rail cars. A stopping means is therefore required to prevent the mine rail cars from rolling out of control.

Skids are frequently used as the stopping means. The skids are inserted on a rail head of the rail tracks at the loading area to contact with a wheel of the mine rail car, thereby interfering with the path of travel of the wheel, thereafter stopping the rotation of the wheel. By preventing rotation of the wheel, movement of the mine cars can be slowed, and eventually stopped, preventing a runaway car situation. Skids are also used as a safety stopping means for the mine cars once the filled mine rail cars have been transported to side spurs where they are stored waiting collection and transportation to the surface where the mined mineral is processed.

A problem exists in the placement of skids behind the wheels of a mine rail car. There is a significant possibility of harm to the operator who must manually insert the skids in place on the rail head upon which the mine rail cars may be moving. Moreover, the skids must be removed from the rail head to permit movement of the mine rail cars. Instances in which the operator has been dragged by the cars or who has had fingers or hands caught underneath the wheels of the mine rail car have been known to occur.

Skids are additionally used as the safety stopping means for rail cars containing the processed mineral awaiting transportation to the surface. Many filled mine cars are frequently queued in the mines facility on rail spurs. The same safety hazard exists here for the operator who must insert the skid onto the rail head as well as remove the skid from the rail head.

Therefore, what is needed is a device which allows safe insertion of a skid behind a wheel of a mine rail car and/or an effective skid construction to permit reliable removal of the skid from the rail head.

SUMMARY OF THE INVENTION

In accordance with the present invention there is provided a skid construction for dislodgement preferably automatically from a rail head and for use with a device to place a skid on a rail head for impeding movement of a rail car on a rail track by remotely inserting a skid to block a wheel of a rail car against further rotation of the wheel. The skid is elongated to extend along a length of a rail head and when supported on the rail head the moment of force due to the force of gravity produces a resultant movement always tending to produce rotation about a longitudinal axis to dislodge a skid from the rail head. In this way, after the wheel of a rail car moves from contact with its skid, the skid rotates toward one side of the rail head and falls from the rail onto the track bed. The device to place the skid on the rail head comprises means on the skid for removable attachment of the skid to an insertion means. The insertion means may be comprised of an elongated arm slidably connected to a base. A mounting arm may be attached at one end of the elongated arm. Pivotally connected to the mounting arm may be a carrier arm to which a skid is removably attached.

The base is positioned proximate to the rail track with its lengthwise direction perpendicular to the rail head. The skid is attached to the carrier arm at a safe distance from the rail head. The slidable connection between the elongated arm and the base allows the elongated arm to be translated along the base therein allowing the skid to be placed on a rail head of the rail track.

The removable attachment of the skid to the carrier arm allows a wheel of a moving mine rail car on the rail track to drag the skid away from the carrier arm. The skid prevents the wheel from rotating thereby increasing the friction between the wheel and the rail head and thereby impeding the movement of the mine rail car.

BRIEF DESCRIPTION OF THE DRAWINGS

The invention may be better understood and further advantages and usages thereof more readily apparent when considered in view of the following detailed description of the exemplary embodiment taken with the accompanying drawings in which:

FIG. 2 is a side view of one embodiment of the mine rail car skid insertion device;

FIG. 4 is a side elevational view of a skid used in the preferred embodiment of the present invention;

FIG. 4A is a front elevational view of a skid showing the connecting means used to connect the skid to the insertion means of the preferred embodiment;

DESCRIPTION OF THE PREFERRED EMBODIMENT

Figure 1:
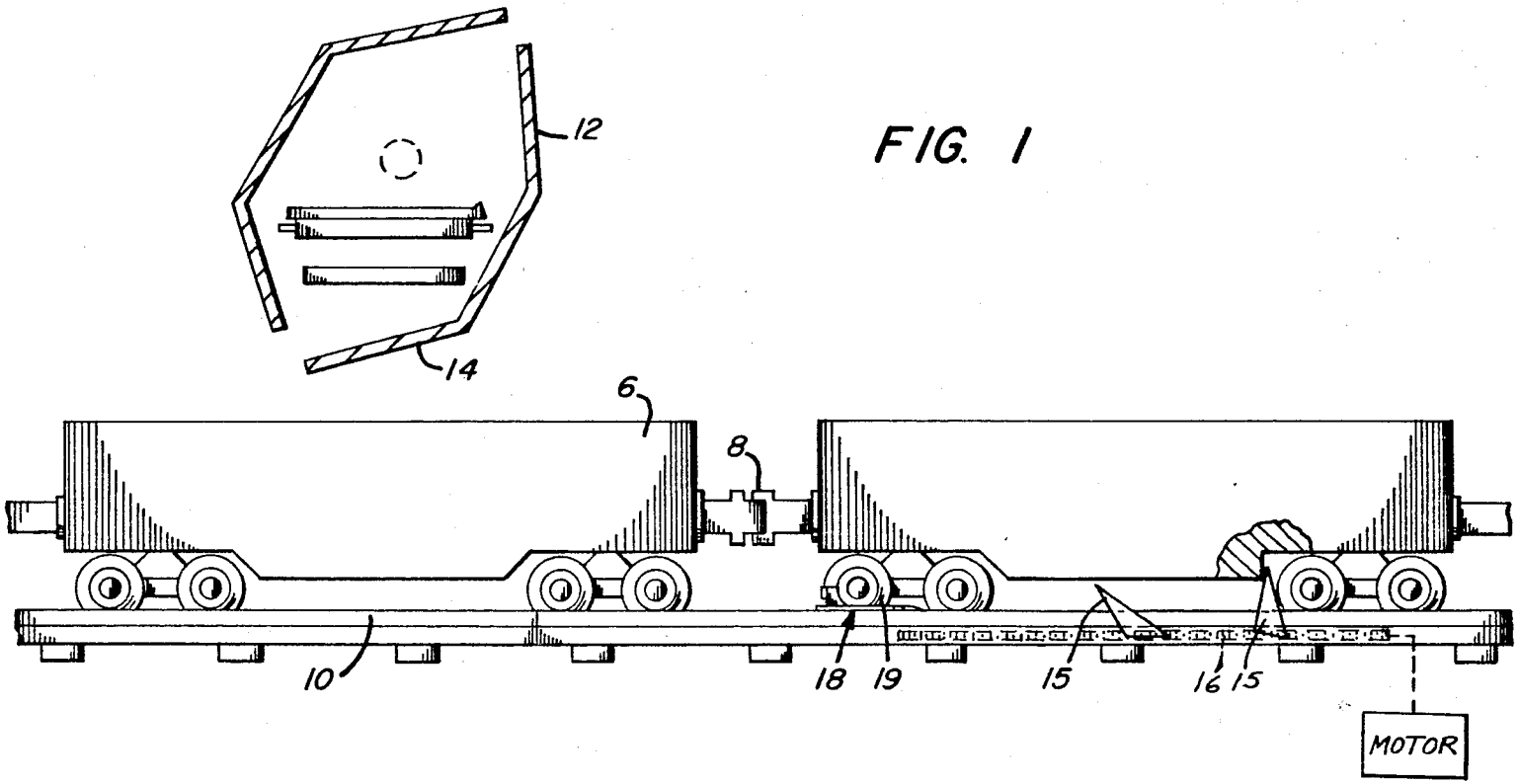
FIG. 1 is a schematic view of a series of mine rail cars on a rail spur at a loading area with a skid of the present invention positioned beneath a wheel of a mine rail car.

Shown in the schematic of FIG. 1 is a system frequently used for loading mine rail cars. A series of mine rail cars 6 attached by connecting means 8 are positioned on a rail spur 10 of a loading area. A loading hopper 12 containing a partially opened bottom 14 is positioned above the rail spur 10. A conveyor means (not shown) conveys the mined mineral into the loading hopper 12. The partially opened bottom 14 of the loading hopper 12 allows the mineral to fall into the mine rail car 6.

Accurate positioning of the mine rail car 6 beneath the loading hopper 12 is required to prevent spillage of the mineral. Once one mine rail car 6 has been filled with the mineral, a subsequent mine rail car 6 must be positioned underneath the loading hopper 12 to allow the loading process to continue. The rail spur 10 of the loading area is frequently constructed on a level or sloping grade. Car spotters 15, which are positioned by hydraulic actuator arms 16 are located between the rails of the spur 10. Actuation of an arm 16 causes the car spotter 15 to push against the mine rail car frame to thereby push the mine rail cars 6. The car spotters 15 are positioned such that once the actuator arm 16 of a first spotter 15 has been fully actuated, an actuator arm 16 of a second spotter 15 is actuated to cause further movement. The car spotters 15 are not rigidly attached to the mine car 6 and, therefore, the cars 6 are not held in position. The momentum of the moving mine cars causes the mine cars 6 to continue to roll along the rail spur 10. If no stopping means existed, the momentum of the mine rail cars 6 would not allow accurate positioning of the mine cars 6 under the hopper 12 and could create an unmanageable situation on a down grade. To prevent such a potential situation from occurring, skids 18 are placed in the path of travel of a certain number of the wheels 19 of the mine rail cars 6. Use of a skid 18 prevents the rotation of the wheel 19. This increases friction and stops the movement of the mine rail cars 6. The skids 18 retard movement of the mine rail cars, and thereby function as a safety means to prevent a runaway car situation.

Referring now to FIG. 2, there is shown one embodiment of the rail car skid insertion device 20. The device 20 is shown proximate to one rail head 22 of a rail spur 10. The rail head 22 is supported on cross members 24, consisting of, for example, timber railroad ties. The rail car skid insertion device 20 may be placed upon one of these members 24.

The rail car skid insertion device 20 consists of a base 26 whose lengthwise direction is placed perpendicular to the rail head 22. A slide bar 28 is slidably connected to the base 26 allowing translation of the slide bar 28 along the base 26.

Figure 3:
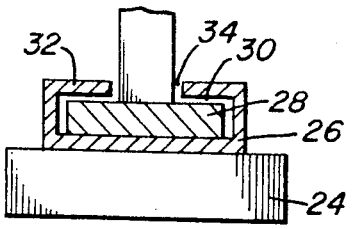
FIG. 3 is a sectional view of the slidable connection between the base and the extension arm.

The slidable connection between the base 26 and slide bar 28 in the preferred embodiment is shown in the sectional view of FIG. 3. The base 26 consists of four sides defining a cavity 30 having a top surface 32. The dimensions of the slide bar 28 allows it to fit in the cavity 30 made by the four walls of the base 26. The top surface 32 of the base contains a gap 34 so as to not cause items mounted on the base 26 to prevent translation of the slide bar 28 along the base 26.

Referring again to FIG. 2, a handle 40 is attached to an end of the slide bar 28 located away from the rail head 22. This handle 40 allows an operator to conveniently provide the push-pull force necessary to translate the slide bar 28 through the base 26. A stop 42 is mounted on the slide bar 28 proximate to the handle 40 with its lengthwise direction perpendicular to the lengthwise direction of the slide bar 28. The stop 42 has a lengthwise direction greater than that of the width of the slide bar 28, and also greater than the width of the cavity 30 of the base 26. The stop 42 prevents translation of the slide bar 28 once translation of the slide bar 28 toward the rail head 22 causes the stop 42 to reach the base 26.

Mounted on the slide bar 28 near its end closest to the rail head 22 is an upstanding mounting arm 44. The side of the mounting arm 44 facing the rail head 22 contains an oblique angle 46. The oblique angle 46 defines an inclined surface 48 and a vertical surface 50. A bore 52 is located proximate to the crest created by the oblique angle 46.

Pivotally connected to the mounting arm 44 is carrier arm 54. A pin 55 extending through bore 52 interconnects to clevice blocks 56 on the carrier arm 54 thereby allowing pivotal motion of the carrier arm 54. This carrier arm 54 contains a broadside face 58 which faces the rail head 22. Prior to translation of the slide bar 28 towards the rail head 22, the bottom surface of the carrier arm 54 rests upon top surface 32 of the base 26. When the slide bar 28 is translated such that the mounting arm 44 is positioned at or beyond the end of base 26 closest to the rail head 22, the carrier arm 54 no longer rests upon the top surface 32 of the base 26, but upon the perpendicular surface 50 of the mounting arm 44. Such a situation is shown in the phantom line of FIG. 2. No longer supported on the top surface 32 of the base 26, the carrier arm 54' pivots around pin 55', and comes to rest against vertical surface 50' of the mounting arm 44'.

A skid 18 is attached to the carrier arm 54 by means of an attaching mechanism. This attaching mechanism may be, for example, a cylindrical rod 62 mounted on the carrier arm 54 in a direction parallel to the direction of the length of the rail head 22, and pointing in a direction away from that of the direction of movement of a mine rail car 6. A skid anchor plate 64 attached to the skid 18 contains a bore hole 66 through which the cylindrical rod 62 may be extended. Such an attaching means allows the skid 18 to be slidably removed from the assembly when a rail car wheel 19 strikes the skid 18.

The skid 18 of the present invention is shown in more detail in FIG. 4. The skid includes a skid plate 67 terminating at a tapered, wheel entry ramp 68. The skid plate 67 and ramp 68 have the same width which is at least equal to but preferably greater than the width of the rail head so that when placed on the top surface of the rail head 22, a rail skid side support 70 extends from one lateral side below skid plate 67 for fitting against the side of the rail head 22. Support 70 stabilizes and provides lateral support for the skid 18. A rail wheel stop 72 containing semicircular surface 74 of a circumference similar to that of a rail car wheel 19 is mounted on the skid plate 67 at an end opposite the entry ramp 68. The skid anchor plate 64 used for attachment of the skid 18 to the carrier arm 54 is attached behind the rail wheel stop 72 such that the bore hole 66 of the anchor plate 64 can receive the cylindrical rod 62. This is shown more clearly in the sectional view of FIG. 4A. Also shown in FIG. 4A is a second attaching mechanism between the skid 18 and carrier arm 54. A hollow rod 76 is connected to the side of the skid plate 67 which is adjacent the carrier arm 54. As shown in FIG. 2, a cylindrical rod 78 containing a 90 degree angle is mounted on a front side of the carrier arm 54. The 90 degree angle causes the cylindrical rod 78 to face the opening in the hollow rod 76. When positioned, the cylindrical rod 78 fits through the opening in hollow rod 76, providing support for the skid plate 67 of the skid 18. The skid anchor plate 64, as best shown in FIG. 4A, which extends from one lateral side of the skid and the skid side support 70 which extends from the opposite lateral side of the skid impose unequal forces due to gravity on opposite lateral sides of the skid. The plate 64 thus also functions as a counterweight to unbalance the skid on the rail head. When a wheel of a mine car rolls out of contact with the skid, the largest force, preferably located at the outer side of the track, causes the skid to pivot on the rail head and fall from the track onto the underlying road bed. It is to be understood that a counterweight member may be extended from a connection with the skid apart from plate 64 to cause the skid to roll out of contact with the rail head.

In operation, the rail car skid insertion device 20 functions to insert a skid 18 in the path of travel of a wheel 19 of a moving mine rail car 6. The device 20 is placed proximate to the rail head 22 of a rail spur 10 upon which a series of mine rail cars 6 rest.

The device 20 is positioned such that its lengthwise direction is perpendicular to the rail head 22. The slide bar 28 is not translated along the base 26 towards the rail head 22, thereby allowing an operator to attach the skid 18 onto the carrier arm 54 at a safe distance from the rail head 22. At this point, the carrier arm 54 rests upon the top surface 32 of the base 26. The skid 18 is positioned on the carrier arm 56 with skid plate 67 at an angle above the horizontal plane.

When insertion of the skid 18 is desired, the operator grasps the handle 40 and pushes in the direction toward the rail head 22. This causes translation of the slide bar 28 along the base 26 through the cavity 30 of the base 26. The carrier arm 54 remains in its position resting upon the top surface 32 of the base 26. As translation continues and the carrier arm 54 nears the rail head 22, the lower portion. of the carrier arm 54 reaches the end of the base 26. Once the carrier arm 54 passes beyond the end of the base 26, it is no longer supported by the top surface 32 of the base 26. This causes the carrier arm 54 to pivot around the pin 55 and then come to rest against the vertical surface 50 of the mounting arm 44. Translation of the slide bar 28 continues until the skid 18 is positioned above the rail head 22. Translation of the slide bar 28, however, is prevented once the stop 42 reaches the far end of the base 26.

Figure 5:
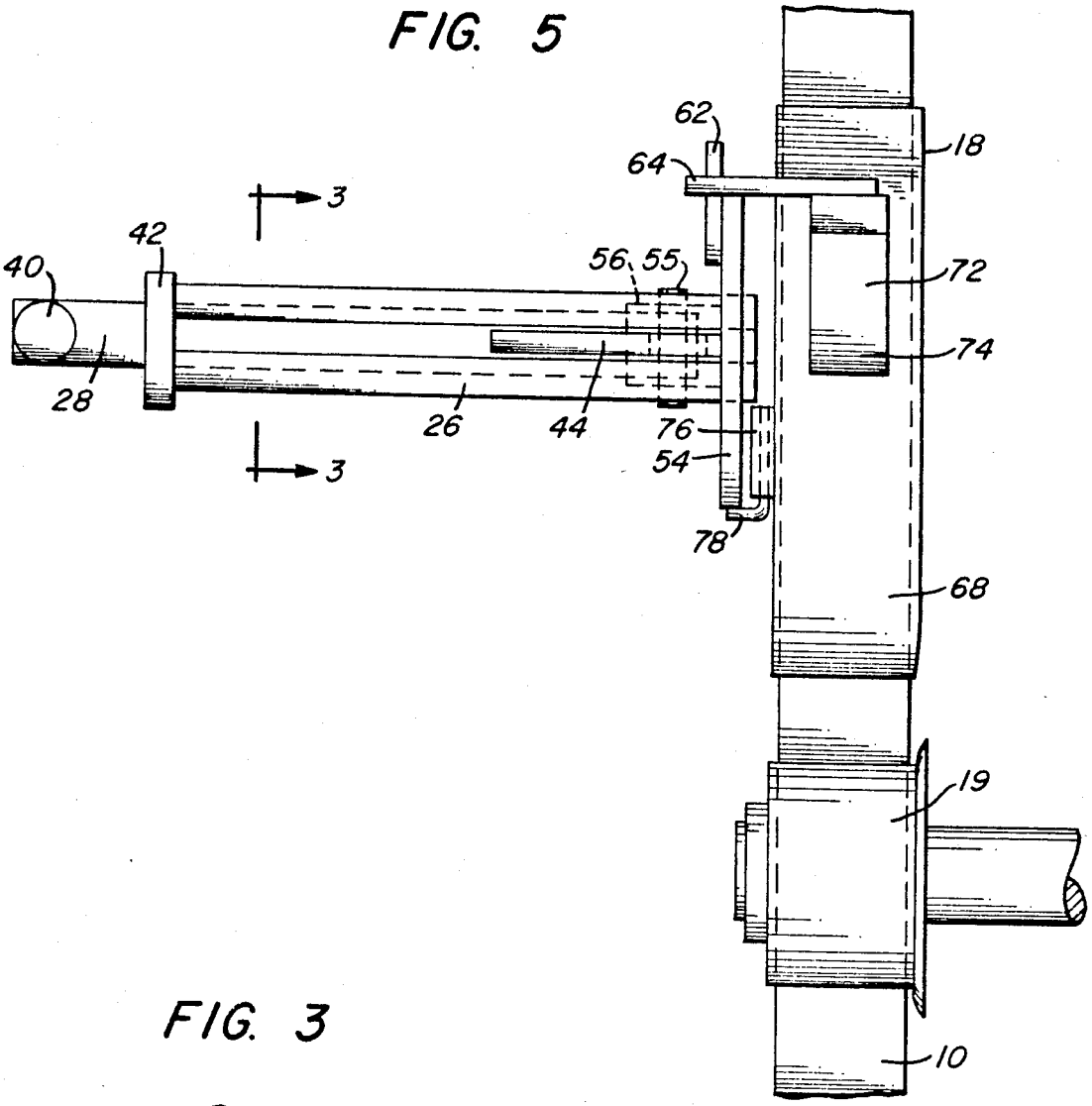
FIG. 5 is an overhead view of the present invention in which the skid is positioned on the rail head.

The overhead view of FIG. 5 illustrates the rail skid insertion device 20 with the skid 18 positioned on the rail head 22. The slide bar 28 is fully translated through the base 26 with the stop 42 in contact with the far end of the base 26, thereby preventing further translation of the slide bar 28. The carrier arm 54 is in a vertical position, and rests against the vertical surface 50 of the mounting arm 44. Cylindrical rod 62 extends through bore hole 66 on the skid anchor plate 64, and circular rod 78 extends through hollow rod 76, thereby supporting the skid 18.

With the skid 18 positioned on the rail head 22 as shown in FIG. 5, the wheel 19 of a moving mine rail car 6 will roll onto the skid plate 67 of skid 18, then strike the rail wheel stop 72, thereby preventing the wheel 19 from continuing to rotate. The momentum of the mine rail car 6 will drag the skid 18 off of the rods 62 and 78 connecting the skid 18 to the carrier arm 54. The skid 18 will be dragged by the mine rail car 6 while causing the mine rail car 6 to stop. After the skid 18 has been removed by the mine rail car, the remaining insertion device 20 may be removed, and another skid 18 may be attached allowing the insertion device 20 to be reused in order to control subsequent movement of the mine rail cars.

Additionally, several rail car skid insertion devices 20 may be used simultaneously to hinder the movement of the mine rail cars 6. The number of the devices used is dependent upon the incline of the rail spur 10, the weight of the mine rail cars 6, and the number of mine rail cars 6.

While the present invention has been described in connection with the preferred embodiment shown in FIG. 2 it is understood that other similar embodiments may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

I claim as my invention:

1. Device for impeding the movement of a rail car on a rail track having a rail head; comprising:

a skid of dimensions allowing placement on the rail head of the rail track, said skid being operative to hinder the rotation of a wheel of the rail car; and insertion means slidable along a guideway for inserting said skid on the rail head of the rail track.

2. The device according to claim 1 wherein the skid includes:

an elongated skid plate having a tapering surface terminating at one end thereof;

upstanding blocking means mounted on said skid plate at a spaced location from said tapering surface, said blocking means presenting a surface for hindering the rotation of a wheel of the rail car; and attaching means for attaching the skid to the insertion means.

3. The device according to claim 1 wherein the insertion means includes:

an elongated base positioned to extend at an angle to the direction of the rail track, said elongated base having a terminal end spaced from the rail track;

an elongated arm having guide surfaces slidably supported by the base such that the elongated arm is capable of translation along the base toward and away from the rail track;

a mounting arm attached to the elongated arm wherein at least one side of the mounting arm faces the rail track; and a carrier arm including means for releasably supporting said skid plate, said carrier arm being connected to pivot on the mounting arm between a first position in which the skid plate is carried to one side of said rail head and a second position in which the skid plate rests on the rail head.

4. The device according to claim 3 wherein said carrier arm includes a plate transverse to the mounting arm and wherein said mounting arm includes face surfaces.

5. The device according to claim 3 wherein said skid plate includes a vertical support surface projecting downwardly along one longitudinal edge of said skid plate for extending along one side of said rail head.

6. The device according to claim 3 wherein said base is positioned at an angle perpendicular to the direction of the rail track.

7. The device according to claim 3 which further includes a stop positioned on the elongated arm so as to prevent translation of the elongated arm beyond a certain point.

8. The device according to claim 3 wherein the first end of the base terminates at a point proximately spaced from a rail head to permit the carrier arm to pivot and lower the skid on the rail head.

9. Device for impeding the movement of a rail car on a rail track having a rail head, comprising:

a skid of dimensions allowing placement on the rail track, said skid operative to hinder the rotation of a wheel of the rail car;

translation means suitable for translating said skid from a remote location to a location proximate to the rail head;

placement means coupled to said translation means for placing the skid on the rail head; and attaching means coupled to said placement means for attaching the skid to the placement means.

10. The device according to claim 9 wherein the skid includes:

an elongated skid plate having a tapering surface terminating at one end thereof; and upstanding blocking means mounted on said skid plate at a spaced location from said tapering surface, said blocking means presenting a surface for hindering the rotation of a wheel of a rail car.

11. The device according to claim 9 wherein the translation means includes:

an elongated base defining an elongated cavity extending in the direction of the length thereof with said base positioned at an angle toward and away from the direction of the rail track; and a slide arm having surfaces guided for movement along the cavity in the base.

12. The device according to claim 11 wherein said base is positioned at an angle perpendicular to the direction of the rail track.

13. The device according to claim 9 wherein the placement means includes:

a mounting arm with at least one side facing the rail track, said side containing an angle, thereby creating a crest, with said crest creating a surface of a first angle and a surface of a second angle; and a carrier arm pivotally connected to the mounting arm, wherein rotation of the carrier arm is limited by at least one of said surfaces of the mounting arm.

14. Device for impeding the movement of a rail car on a rail track having a rail head; comprising:

a skid of dimensions allowing placement on the rail head of the rail track, said skid being operative to hinder the rotation of a wheel of the rail car; and means extending from one lateral side of said skid for unbalancing support of said skid on the rail head of the rail track to permit the skid to fall onto a road bed at one lateral side of the rail track when the said wheel moves from contact with the skid.

15. The device according to claim 14 wherein said means includes a counterweight extending from one lateral side of said skid.

16. The device according to claim 14 wherein said means includes a plate extending from one lateral side of said skid.

17. The device according to claim 16 further including insertion means engagable with said plate for inserting said skid on the rail head of the rail track.

18. The device according to claim 17 wherein said skid includes:

an elongated skid plate having a tapering surface terminating at one end thereof;

upstanding blocking means mounted on said skid plate at a spaced location from said tapering surface, said blocking means presenting a surface for hindering the rotation of a wheel of the rail car; and attaching means for attaching the skid to said insertion means.

* * * * *